United States Patent [19]

Pecoraro

[11] 4,088,588

[45] May 9, 1978

[54] POLYISOBUTYL CARBOXYLIC ACID AMIDES

[75] Inventor: Joseph Michael Pecoraro, Burlington, N.J.

[73] Assignee: E. I. Du Pont de Nemours and Company, Wilmington, Del.

[21] Appl. No.: 701,749

[22] Filed: Jun. 30, 1976

[51] Int. Cl.[2] ..... C07C 103/34; C10M 1/36

[52] U.S. Cl. ..... 252/51.5 A; 44/63; 44/71; 260/561 R

[58] Field of Search ..... 260/561 R; 252/51.5 A

[56] References Cited

U.S. PATENT DOCUMENTS

| | | | |
|---|---|---|---|
| 3,414,594 | 12/1968 | Dubeck | 252/56 R X |
| 3,931,024 | 1/1976 | Hu | 252/51.5 A X |

FOREIGN PATENT DOCUMENTS

| | | | |
|---|---|---|---|
| 1,444,906 | 2/1969 | Germany | 252/51.5 A |

*Primary Examiner*—Allen B. Curtis

*Attorney, Agent, or Firm*—James A. Costello

[57] ABSTRACT

Carboxamide compositions comprising N-substituted amides of polyisobutylcarboxylic acids, said acids consisting essentially of a mixture of (i) at least about 80%, by weight, of a polyisobutylcarboxylic acid component characterized by substantially all carboxyl groups being attached to tertiary carbon atoms, and by less than about 20% of said acid component being extractable by successive treatments at 25° C with aqueous alkali and with water, and (ii) up to about 20%, by weight, of a neutral polyisobutyl component, the polyisobutyl portions of components (i) and (ii) having an average molecular weight of about 750 to 3000;

the N-substituted component of the carboxamide having the formula, —N(R)Z, where R is hydrogen or lower alkyl and Z is a particular heterocyclic or aliphatic polyamine.

9 Claims, No Drawings

POLYISOBUTYL CARBOXYLIC ACID AMIDES

BACKGROUND OF THE INVENTION

1. Field of the Invention

This invention relates to polyisobutylcarboxylic acid amide compositions useful as detergent additives in hydrocarbon fuels and oils.

2. Description of the Prior Art

Detergent-dispersant additives for hydrocarbon fuels and oils share the common characteristics of a relatively long-chain hydrocarbon oleophilic group having one or more highly polar groups thereon. Such additives may be acids, amides, imides and the like.

Currently employed commercial detergent-dispersants include N-substituted long-chain alkenyl succinimide and related products usually prepared by the condensation of a polyamine with the reaction product of a long-chain olefin and maleic anhydride. Generally, the long-chain alkenyl group is a polyisobutenyl group derived from polyisobutylene having a molecular weight of about 800 to 1500.

While the N-substituted polyisobutenylsuccinimide dispersants are effective, particularly at low temperatures, they have not been entirely satisfactory because of their susceptibility to oxidation (because of the unsaturated polyisobutenyl group) and their tendency towards hydrolysis (of the imide group). Such oxidation and hydrolysis will impair their effectiveness as detergent-dispersant additives for hydrocarbon fuels and lubricating oils.

Potential sources of detergent-dispersants having amide functionally include polyisobutylenes derived from isobutylenes which have oxidizable olefinic linkages at or near terminal carbon atoms. U.S. Pat. No. 3,647,691 discloses additives for lubricating oils which are condensation products of certain amines with long-chain ketones or aldehydes prepared by the reaction of polyolefins (including polyisobutylenes) with ozone. British patent specification No. 1,027,410 discloses lubricant additives which are condensation products of certain amines with the nitric acid oxidation product of polyisobutylenes.

U.S. Pat. No. 3,715,313 discloses oxidation of certain polyisobutylenes with ozone followed by hydrogen peroxide to provide polyisobutylcarboxylic acids in about 30% yield. U.S. Pat. No. 3,219,666 concerns polyisobutenylsuccinic acid derivatives as well as nontertiary polyisobutylcarboxylic acids. U.S. Pat. No. 3,897,224 concerns amides made from acids which have significant unsaturation and a significant number of nontertiary carbon atoms. U.S. Pat. No. 3,931,024 concerns amine additives prepared from high molecular weight oxygenated polyolefins which are made by heating the polymer in the presence of air. British patent specification No. 1,172,818 concerns condensing a polyamine with a ketone which is made by ozonizing a polyolefin and treating the ozonized polyolefin with hydrogen.

Several weaknesses, alone or in combination, characterize each of the various products of the art. The weaknesses include poor oxidative stability, and too-low acid contents. One skilled in the art will appreciate the difficulty of separating polyisobutylcarboxylic acids from a reaction mixture of such acids and a neutral by-product in an effort to concentrate the acid portion (more desirable) of the reaction product. Thus, one skilled in the art will appreciate the desirability of obtaining oxidation products of high acid content without the need to further concentrate the acid.

SUMMARY OF THE INVENTION

This invention concerns carboxamide compositions comprising N-substituted amides of polyisobutylcarboxylic acids, the polyisobutylcarboxylic acid component of the carboxamide being derived from a mixture of (i) at least about 80%, by weight, of a polyisobutylcarboxylic acid component characterized by substantially all carboxyl groups being attached to tertiary carbon atoms, and by less than about 20% of said acid component being extractable by successive treatments at 25° C with aqueous alkali and with water, and (ii) up to about 20%, by weight, of a neutral polyisobutyl component, the polyisobutyl groups of components (i) and (ii) having an average molecular weight of about 750 to 3000, the N-substituted component of the carboxamide having the formula, —N(R)Z, where R is hydrogen or lower alkyl, and Z is

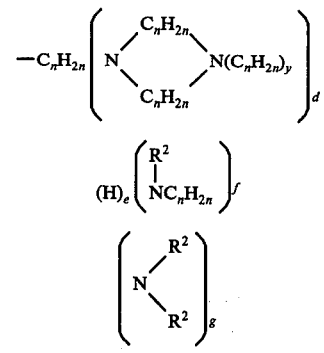

where $n$ is 2 or 3, $R^2$ is independently hydrogen or lower alkyl, $d$, $e$, $g$ and $y$ are 0 or 1, and $f$ is 0 to 5, with the provisos that:

a. when $d = 0$, then $e = 0$, $f = 1$ to 5 and $g = 1$, b. when $d = 1$ and $y = 0$, then $e = 1$ and $f$ and $g$ are 0, and c. when $d = 1$ and $y = 1$, then $e = 0$, $f = 1$ to 5 and $g = 1$.

Preferred carboxamide compositions of this invention have molecular weights in the range of about 1200 to 2000. Preferred compositions are those wherein $n = 2$, $d = 0$, and $R = R^2 =$ hydrogen, i.e. where the N-substituted component is $—NHC_2H_4(NHC_2H_4)_3NH_2$. Also preferred are compositions where $n = 3$, $d = 0$, R = hydrogen, and $R^2 = CH_3$ or hydrogen, e.g. where the N-substituted component is $—NHC_3H_6N(CH_3)C_3H_6NH_2$.

By "consisting essentially of" as employed herein is meant that no undisclosed ingredients are contained in the two-component mixtures which would significantly affect their utility as fuel and oil additives.

DETAILS OF THE INVENTION

The Polyisobutylcarboxylic Acid Component

A brief description of the manner of preparing the polyisobutylcarboxylic acid component is given hereafter with further details to be found in my coassigned patent applications, filed concurrently herewith, entitled "Polyisobutylcarboxylic Acid Composition", Ser. No. 701,750 filed June 30, 1977, now abandoned, and "Polyisobutylene Oxidation Process", Ser. No. 701,748 filed June 30, 1977.

Polyisobutylene From Which The Acid Component Is Made

Polyisobutylenes are normally prepared by cationic polymerization of isobutylene. Polyisobutylenes consist predominantly of 1,2-isobutylene units represented by, $—CH_2—C(CH_3)_2—$. Polymer unsaturation is predominantly at the alpha or the beta position represented by, $RCH_2—C(CH_3)=CH_2$, and, $RCH=C(CH_3)_2$, where R represents a polyisobutyl group. In commercial polyisobutylenes about 80% of the unsaturation is believed to be at the beta position and about 20% at the alpha position.

In the context of the present invention, the term "polyisobutylene" means a hydrocarbon polymer containing 1,2-isobutylene units derived from isobutylene; there being present a total of up to 10% of units derived from low molecular weight monoolefins such as 1-butene and 2-butene, and from cleaved, isomerized or oligomerized isobutylene; said polymer containing an olefinic linkage at or near the terminal carbon atom of the polymer chain. The term "polyisobutyl" refers to the saturated hydrocarbon radical derived from such polyisobutylene. It is preferred for reasons of economy and ready availability to employ commercial polyisobutylenes for the preparation of the carboxylic acid compositions.

Not included within the above-described scope of polyisobutylenes are copolymers of isobutylene and conjugated dienes. Such polymers, characterized by the presence of several olefinic linkages distributed in the polymer chain for cross-linking purpose, suffer extensive cleavage of the polymer chain with attendant loss in molecular weight when functionalized by the oxidation of the olefinic linkages.

Process For Making The Acid Component Of The Invention Amides

The first step of the preferred (ozonization) reaction process is to contact the polyisobutylene with ozone. Since the polyisobutylenes in the defined molecular weight range tend to be viscous, it is convenient (but not necessary) to dissolve them in an ozone-inert solvent for the ozonization reaction. Useful solvents include hexane, heptane, octane, petroleum ethers, benzene, toluene, xylene, methylene chloride, chloroform, carbon tetrachloride, dichloroethane, tetrachloroethane, and the like. The preferred solvents are nonhydroxylic solvents such as carbon tetrachloride, since they provide for higher yields of the polyisobutylcarboxylic acids in the overall process.

Ozone is usually supplied with a carrier gas such as nitrogen, air or oxygen. It is preferred that the carrier gas be either air or oxygen. The ozone concentration in the diluent gas is not critical and any practical concentration can be used. Concentrations of about 1 to 10% are preferred for convenience.

The reaction between the polyisobutylene and ozone is carried out at about —80° C to 60° C, preferably at about —10° C to 30° C. Ozone is conveniently supplied at a rate such that the exit gases from the reaction mixture are just devoid of ozone and the supply is continued until ozone is detected in the exit gases. Sodium or potassium iodide solutions can be used to detect the breakthrough of unreacted ozone.

Normally, one mole of ozone is utilized per mole of polyisobutylene and the uptake of the first mole of ozone per mole of polyisobutylene is fairly rapid. However, it is advantageous to continue the ozone addition until a total of, say, 2 to 4 moles of ozone per mole of polyisobutylene are added. Higher overall yields of polyisobutylcarboxylic acid are thereby obtained. A greater excess of ozone can be used but may tend to degrade the molecular weight of the product.

In the context of the present invention, the term "ozonized polyisobutylene" refers to polyisobutylene treated with ozone as described above. Inspection of said ozonized polyisobutylene by infrared and nuclear magnetic resonance techniques indicates the product consists predominantly of polyisobutyl ketones.

The ozonized polyisobutylene is converted to the invention polyisobutylcarboxylic acid composition, in a second step, by oxidation with nitric acid. When the solvent used in the ozonization step is inert to nitric acid, the ozonized polyisobutylene need not be isolated before its reaction with nitric acid. A preferred range of 59% to 72%. of nitric acid is used having a specific gravity of 1.32 to 1.42. However, lower or higher concentrations can be employed. For each part by weight of ozonized polyisobutylene, from about 0.2 to 1 part of concentrated (70%) nitric acid (sp. gr. 1.42) or its equivalent is used for the oxidation.

The oxidation temperature will depend upon several factors such as the concentration of the ozonized polyisobutylene (when a solvent is used) and the amount and the concentration of the nitric acid. Generally, when nitric acid of sp. gr. 1.42 is used, temperatures of about 20° C to 110° C, preferably 40° C to 100° C, are used. Temperatures above about 110° C should be avoided to minimize the depolymerization of the polyisobutyl chain. The time of reaction is also dependent upon the factors mentioned above but usually about 2 hours to 24 hours are used. If desired, ingredients such as sulfuric acid, phosphoric acid, vanadium compounds, manganese compounds, and surfactants can be present during the reaction process.

The nitric acid oxidation reaction mass is worked up by conventional means such as washing with water or a water-alcohol mixture to remove nitric acid and low molecular weight by-products, and then distilling to remove volatile solvent. The yield of polyisobutylcarboxylic acid obtained is about 80% to 98%, based on the starting polyisobutylene. The polyisobutylcarboxylic acid compositions are normally liquid and are readily handled as such or as solutions in hydrocarbon solvents.

Amines From Which The N-Substituted Component Is Made

Suitable amines for the preparation of the invention polyisobutylcarboxylic acid amides are represented by the formula

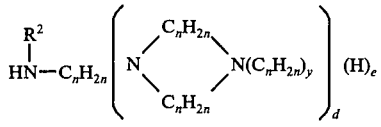

-continued

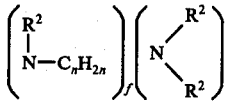

where $n$ is 2 or 3, $R^2$ is independently hydrogen or lower alkyl, $y$, $d$, $e$, $g$ and $y$ are 0 or 1, $f$ is 0 to 5 with the provisos that a. when $d = 0$, then $e = 0$, $f = 1$ to 5 and $g = 1$, b. when $d = 1$ and $y = 0$, then $e = 1$ and $f$ and $g$ are 0, and c. when $d = 1$ and $y = 1$, then $e$ is 0, $f = 1$ to 5 and $g = 1$.

All of these amines have 3 or more amino nitrogens. Lower alkyl groups contain 1 to 4 carbon atoms. Included among the contemplated amines are acyclic alkylene polyamides ($d = 0$ in the above formula) which are:

(a) polyethylenepolyamines such as diethylenetriamine, triethylenetetraamine, tetraethylenepentamine, pentaethylenehexamine, and hexaethyleneheptamine, (b) polypropylene polyamines including 1,2- or 1,3-propylene compounds such as dipropylenetriamine, tripropylenetetramine, tetrapropylenepentamine, pentapropylenehexamine, and hexaethyleneheptamine, (c) N, N-bis(aminoalkyl)alkylamines where the alkyl has 1 to 4 carbon atoms and the aminoalkyl has 2 to 3 carbon atoms such as N,N-bis(aminoethyl)methylamine, N,N-bis(aminoethyl)ethylamine, N,N-bis(aminoethyl)butylamine, N,N-bis(aminopropyl)-propylamine, N,N-bis(aminopropyl)butylamine, and (f) polyamines containing both ethylene and propylene groups such as: $H_2NC_3H_6N(H)—C_2H_4N(H)C_3H_6NH_2$, $H_2NC_3H_6(NH)C_2H_4)_2C_3H_6NH_2$, $H_2NC_3H_6(N(H)C_2H_4)_4C_3H_6NH_2$, and $CH_3—N(C_2H_4NHC_3H_6NH_2)_2$.

Also included among the suitable amines are alicyclic amines ($d = 1$ in the above formula) particularly those containing piperazine rings represented by

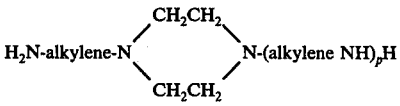

where "alkylene" has 2 or 3 carbon atoms and can be a 1,2-or 1,3-alkylene group, and $p$ is 0 to 3. Representative examples of such amines include,

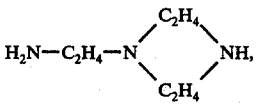

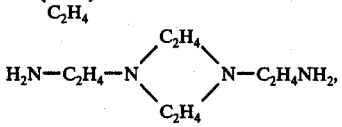

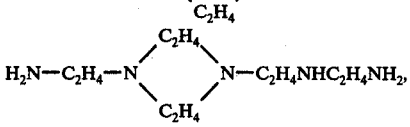

-continued

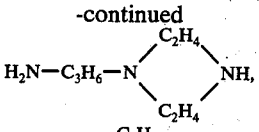

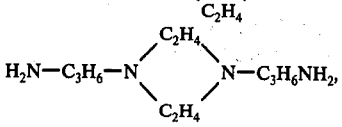

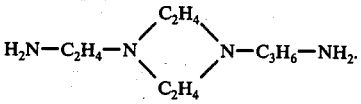

Most of the above-described amines are available commercially. Others can be prepared easily by methods known in the art. Useful mixtures of amines are mixtures of ethylenepolyamines, prepared by the reaction of ethylenedichloride and ammonia, having compositions which correspond to that of tetraethylenepentamine and which are available commercially under the tradenames Polyamine H® and Polyamine M® (Union Carbide Corporation).

Preparation Of The Invention Carboxamides

The carboxamides of this invention are prepared by the condensation of a polyisobutylcarboxylic acid, as described, with a polyamine, as described, in the usual manner for preparing amides from carboxylic acids and amines.

Normally, equivalent amounts of the acid and the amines are heated to a temperature in the range of about 60° C to 200° C for a time sufficient for the reaction to occur. By equivalent amounts of acid and amine is meant that for each mole of —COOH functionality in the acid there is present one mole of either $H_2N$— or HN— functionality in the amine.

Since the amine reactant is a polyamine the resulting carboxamide will have in addition to an amide group, one or more amino groups and can also be referred to as an aminoamide. The reaction mixture is kept at the reaction temperature until sufficient water of condensation has been evolved and removed. The reaction can be carried out in the absence of a solvent but it is preferable to use one, particularly one which distills with water azeotropically. Suitable solvents are hydrocarbons boiling in the range of 65° C to 205° C and include among others hexane, cyclohexane, n-octane, isooctane, benzene, toluene, xylene and mixtures thereof. The amount of solvent used, if any, is about 10% to 90% by weight of the total reaction mixture.

The use of a solvent not only facilitates the reaction but some or all of the solvent can be retained with the reaction product to provide the carboxamide composition as a solution. Such a solution makes handling and incorporation of the composition into the substrate easier. The solution will normally contain from 10% to 95%, preferably 40% to 80%, more preferably 50% to 75% by weight of the carboxamide composition in a single solvent or a mixture of solvents such as those exemplified above. Mineral oils of lubricating viscosities can also be used as solvents.

Other methods known in the art to prepare amides from carboxylic acids and amines such as that of first converting the polyisobutylcarboxylic acids to the corresponding acid chlorides e.g. with thionyl chloride, and then condensing the acid chloride with an amine can also be used.

The invention carboxamide compositions are useful in hydrocarbon fuels such as gasoline to provide carburetor detergency and the control of quick-heat intake manifold deposits. Normally, the gasoline will contain about 0.004 to 0.1 percent by weight of the invention compositions, i.e. 10 to 250 pounds per thousand barrels (ptb), preferably about 0.01 to 0.06 weight percent (25 to 150 ptb).

The hydrocarbon fuel to which the present invention composition is added to impart the desired detergency characteristics comprises gasoline or a mixture of hydrocarbons boiling in the gasoline range which is normally in the range of about 32° C to 205° C. The base fuel can consist of straight chain or branched chain paraffins, cycloparaffins, olefins and aromatic compounds or any mixture of such hydrocarbons obtainable from straight run naphtha, polymer gasoline, natural gasoline, thermally or catalytically cracked hydrocarbon stocks and catalytically reformed stocks.

The gasoline can also contain conventional gasoline additives such as anti-knock compounds, dye, antioxidants, antiicing agents, rust inhibitors, detergents, and anti-preignition agents, as well as intake valve deposit control additives such as nonvolatile lubricating mineral oils of 500 to 1500 SUS viscosity at 100° F, and low molecular weight polypropylenes and polybutenes.

The invention carboxamide compositions are useful in lubricating oils as detergent-dispersants. The oils into which the invention compositions can be incorporated are oils of lubricating viscosity derived from a petroleum source and can be paraffinic or naphthenic. Oils of lubricating viscosity normally have viscosities in the range of 35 to 50,000 Saybolt Universal Seconds (SUS) at 100° F, more usually from about 50 to 10,000 SUS at 100° F.

The amount of the invention composition incorporated into the lubricating oils generally will be about 0.1 to 15 percent by weight, more usually about 0.25 to 10 percent by weight.

Other conventional lubricating oil additives can also be present in the lubricating oils. These additives include pour point depressants, viscosity index improvers, antiwear agents, rust inhibitors, corrosion inhibitors, detergents, dispersants, antioxidants and the like.

The invention compositions, in addition to providing the desired detergency in hydrocarbon fuels and lubricating oils, also have increased resistance towards oxidation and hydrolysis. The increased stability is believed to be due, in part, to the unusual features of the polyisobutylcarboxylic acid composition. The absence of an olefinic linkage in the polyisobutyl chain enhances the oxidative stability while the fact that the carboxyl groups in the polyisobutylcarboxylic acid compositions are predominantly tertiary, i.e. carboxyl groups are attached to carbon atoms of the polyisobutyl groups which are devoid of hydrogen, enhance the hydrolytic stability.

Characterization Of The Invention Compositions

Set out below are several characteristics of the polyisobutylcarboxylic acids from which the amides of this invention are made. One skilled in the art will be able to determine whether any given amide composition is within the scope of this invention based on these characteristics of the starting acids together with the other disclosure presented herein.

(1) The reactant polyisobutylcarboxylic acid composition has an acid content of at least about 80% by weight of the composition. The predominant portion of the polyisobutylcarboxylic acid is a monocarboxylic acid wherein substantially all of the carboxyl groups are attached to tertiary carbon atoms (i.e. carbon atoms having no hydrogen attached thereto) of the polyisobutyl group. Depending upon the severity of the ozonization and the nitric acid oxidation steps, the polyisobutylcarboxylic acid component can contain up to about 20%, by weight of the acid components, of a polyisobutyldicarboxylic acid component (the carboxyl groups also being attached to tertiary carbon atoms).

The presence of carboxylic acid groups attached to tertiary carbon atoms is detected by infrared spectroscopy, 220 MHz Nuclear Magnetic Resonance (NMR) spectroscopy. That substantially all carboxyl groups of the invention polyisobutylcarboxylic acids are attached to tertiary carbon atoms is notable since derivatives of such acids show exceptionally good resistance to hydrolytic degradation.

Infrared spectroscopy shows the presence of a carboxylic acid group by a strong absorption band at 1710 $cm^{-1}$. Should a weak absorption band appear at 1550 $cm^{-1}$ said band indicates the presence of an aliphatic nitro group. The 220 MHz NMR spectroscopy shows the presence of a carboxylic acid group by a strong peak at 11 ppm. The $^{13}C$ NMR spectroscopy shows a tertiary carboxylic acid group by a major downfield peak at 185 ppm. Two small peaks at 177.8 ppm and 178.2 ppm indicate the presence of a dibasic tertiary carboxylic acid.

(2) Invention compositions have substantially the same molecular weight as the starting polyisobutylene as indicated by Gel Permeation Chromatography.

(3) They have an acid number of about 15 to 73. The acid number, defined as milligrams of potassium hydroxide required to neutralize all acidic constituents in a 1 g sample, depends upon the molecular weight of polyisobutylcarboxylic acid. Thus, when the molecular weight of the polyisobutyl groups is 750, the acid number will be about 60 to 73, and when the molecular weight is 3000 the acid number will be about 15 to 18. The acid number is conveniently determined by a conventional direct titration method including the potentiometric method of ASTM D 664. Starting with a polyisobutylene of a given molecular weight, the observation that the acid number is very close to the theoretical acid number, coupled with the retention of the molecular weight in the polyisobutylcarboxylic acid indicate that the predominant proportion of the carboxylic acid compositon is a polyisobutylcarboxylic acid.

(4) There is present less than about 20%, by weight, of neutral polyisobutyl component. The neutral (non-acidic) component is predominantly polyisobutyl ketone as indicated by infrared spectroscopy and nuclear magnetic resonance spectroscopy. There may also be present a small amount of unreacted polyisobutylene as well as some saturated polymer.

That the carboxylic acid compositions contain only a minor proportion of a neutral polyisobutyl component is important because the polymeric nature of the products makes the separation of the polyisobutylcarboxylic acid component from the rest of the reaction mixture difficult and costly.

(5) A predominant proportion of the acid component of the carboxylic acid composition is not extractable by aqueous alkali and water at 25° C. Extractability of the acid is determined by dissolving a given weight of the carboxylic acid compositon in diethylether and extracting with aqueous 10% sodium carbonate solution (one half volume) followed by extraction with water (one half volume). The aqueous layers are combined, acidified with excess hydrochloric acid and extracted with diethyl ether. The ether layer is separated and dried and the ether is removed by evaporation to yield the extractable acid.

The proportion of nonextractable acid component increases with increasing size of the polyisobutyl groups. It is believed that the extractable acids are derived primarily from the very low molecular weight fractions of the polyisobutylene. In acid compositions obtained from polyisobutylene of 750 molecular weight, usually less than about 20% of the acid is extractable whereas in acid compositions prepared from polyisobutylene of 3000 molecular weight, usually less than about 5% of the acid is extractable.

The following Preparations and Examples illustrate how to make and use the compositions of this invention.

Preparation A

Typical Polyisobutylcarboxylic Acid From Which The Invention Amides Are Made

Reaction with Ozone

Commercial polyisobutylene of about 1500 molecular weight, 80 g, was dissolved in 400 ml of carbon tetrachloride in a reaction flask equipped with a gas inlet tube, a mechanical stirrer and a reflux condenser. The reaction mixture was maintained at 25° C by means of an external bath. Ozone-oxygen was passed into the polyisobutylene solution for 2 hours at the rate of 23.6 ml/min. (66 mg ozone per minute). Carbon tetrachloride was removed under reduced pressure. The reaction product was characterized as predominantly polyisobutyl ketone by means of infrared spectroscopy and nuclear magnetic resonance spectroscopy.

Oxidation with Nitric Acid

Ozonized polyisobutylene prepared as above, 300 g, was dissolved in 250 ml of carbon tetrachloride in a reaction flask equipped with an agitator, a condenser, a thermometer and an addition funnel, and 100 g concentrated (70%) nitric acid was added. The reaction mixture was kept at 20° to 30° C by means of an external bath and over a period of 2 hours 50 g of concentrated sulfuric acid was added. The reaction mixture was then heated to reflux at 65° to 70° C and kept at reflux for 16 hours. About 300 ml of n-hexane was added to the reaction mixture and the solution was washed with a 1:1 by volume mixture of isopropanol-water until free of acid. The solution was dried over anhydrous sodium sulfate, filtered and the solvent removed under reduced pressure leaving a liquid product. The acid number was 33 as determined electrometrically according to ASTM D664 Method. Based on the theoretical acid number of 37.3 for a polyisobutylcarboxylic acid of 1500 molecular weight, the yield of polyisobutylcarboxylic acid was 88.5%.

Preparation B

Typical Polyisobutylcarboxylic Acid From Which The Invention Amides Are Made

Reaction With Ozone

Commercial polyisobutylene of about 1500 molecular weight, 80 g, was dissolved in 400 ml of carbon tetrachloride in a reaction flask equipped with a gas inlet tube, a mechanical stirrer and a reflux condenser. The reaction mixture was maintained at 25° C by means of an external bath. Ozone-oxygen was passed into the polyisobutylene solution for 2 hours at the rate of 23.6 ml/min. (66 mg ozone per minute). Carbon tetrachloride was removed under reduced pressure. The reaction product was characterized as predominantly polyisobutyl ketone by means of infrared spectroscopy and nuclear magnetic resonance spectroscopy.

Oxidation with Nitric Acid

Ozonized polyisobutylene prepared as above, 150 g, was dissolved in 400 ml of carbon tetrachloride in a reaction flask equipped with an agitator, a condenser, a thermometer and an addition funnel. Vanadium pentoxide, 6 g, and Aliquot 336 (a surfactant), 15 g, were added to the solution. To the mixture was added 75 g of 70% nitric acid over a period of 1 hour. The mixture was then heated to reflux, 65° to 70° C, and kept at reflux for 9 hours. The reaction mixture was then allowed to cool to room temperature and 45 ml of concentrated sulfuric acid was added over a 1 hour period. The mixture was again heated to reflux and kept at reflux for 3 hours during which period an additional 45 ml of sulfuric acid was added over a period of about 1 hour. Refluxing was continued for 5 hours after the completion of sulfuric acid addition.

The reaction mixture was cooled and poured into water and washed with water three times. The mixture was then dried over sodium sulfate, filtered and the solvent was removed under reduced pressure. The acid number was 36.7 which indicated a conversion of polyisobutylene to polyisobutylcarboxylic acid of 98%.

EXAMPLE 1

In a reaction flask equipped with an agitator, a thermometer, a condenser and a Dean-Stark water separator was placed 41.1 g of a polyisobutylcarboxylic acid prepared generally as described in either of Preparations A or B above. Then, 10 g of tetraethylenepentamine and 200 ml of xylene was added. The reaction mixture was refluxed, 135° to 140° C, for 20 hours during which time the water evolved was separated and removed in the water separator. The reaction mixture was washed with a 1:1 isopropanol-water mixture (3 × 50 ml). The removal of the solvent under reduced pressure provided the aminoamide of the polyisobutylcarboxylic acid, 44.3 g. Infrared spectroscopy showed a strong absorption band at 1680 $cm^{-1}$ indicative of the carboxylic acid amide grouping.

According to the process of this Example, caboxamide compositions can be prepared from polyisobutylcarboxylic acids having molecular weights of about 800, 1260 and 1400.

EXAMPLE 2

Into a reaction flask equipped with an agitator, an addition funnel, a thermometer and a condenser was added 150 ml of chloroform and 30 g of a polyisobutylcarboxylic acid prepared generally in accordance with either of the ozonation/nitric acid oxidation Preparations A or B above. Thionyl chloride (5 ml) was added to the reaction mixture. An additional 5 ml of thionyl chloride dissovled in 50 ml of chloroform was added dropwise from the addition funnel. Solvent and unreacted thionyl chloride (as well as by-products HCl and $SO_2$) were removed under reduced pressures. The residue was dissolved in 150 ml of chloroform, and 10 g of tretraethylenepentamine in 50 ml of chloroform was added dropwise from the addition funnel. The reaction mixture was refluxed overnight and filtered. The solvent was distilled away and the residue dissolved in 200 ml of hexane. The hexane solution was washed with a 1:1 isopropanol-water mixture (3 × 100 ml) and dried over anhydrous sodium sulfate. The removal of the solvent by distillation provided 29.4 g of an aminoamide of the polyisobutylcarboxylic acid essentially identical to that prepared in Example 1.

According to the process of this Example, carboxamide compositions can be prepared from polyisobutylcarboxylic acids having molecular weights of about 800, 1260 and 1400.

EXAMPLES 3 TO 6

Using the general procedures described in Examples 1 or 2, carboxamides of this invention are prepared by reacting an amine with an equivalent amount of polyisobutylcarboxylic acid (1500 mw) prepared according to either of the general procedures described in Preparations A or B above. In like manner, carboxamides of the invention can be prepared from polyisobutylcarboxylic acids having molecular weights of 800, 1260 and 1400. The residue of each of the amine reactants is listed below and is equivalent to the —N(R)Z component of the general formula given above in the "Summary of the Invention".

EXAMPLE 3

The N-substituted component of the carboxamide is $$-NH-C_3H_6(\overset{H}{N}-C_2H_4)_4\overset{H}{N}-C_3H_6-NH_2.$$

EXAMPLE 4

The N-substituted component of the carboxamide is $$-NH-C_3H_6-\overset{CH_3}{\overset{|}{N}}-C_3H_6-NH_2.$$

EXAMPLE 5

The N-substituted component of the carboxamide is $$-NH-C_3H_6-\overset{H}{N}-C_2H_4-\overset{H}{N}-C_4H_6-NH_2.$$

EXAMPLE 6

The N-substituted component of the carboxamide is $$-NH-C_3H_6-\overset{H}{N}-C_3H_6-\overset{CH_3}{\overset{|}{N}}-C_3H_6-\overset{H}{N}-C_3H_6-NH_2.$$

Comparative Example

The oxidation of polyisobutylene with nitric acid was carried out as described in the Example of British patent specification No. 1,027,410, as follows. Polybutene® 32 (approximately 1400 molecular weight) 100 g, concentrated nitric acid (70%), 79 g, and water, 30 g, were placed in a reaction flask equipped with a condenser, a thermometer and an agitator. The content of the flask was agitated and heated at reflux (107° C) for 4 hours. The reaction mixture was cooled, 300 ml of hexane added, and washed with a 3:1 (v/v) mixture of isopropanol and water until the wash liquid was acid-free. The removal of the solvent at 80° to 90° C at 4 to 5 mm pressure yielded 93.7 g of the "oxidized product". The following characterizations of the "oxidized product" were determined.

1. Elemental analysis showed 1.4% nitrogen;
2. Infrared spectroscopy showed a very strong absorbance band at 1550 $cm^{-1}$ indicative of aliphatic nitro compounds and a very weak band at 1710 $cm^{-1}$ which indicates the presence of a very small amount of a carbonyl group;
3. $^{13}C$ Nuclear Magnetic Resonance Spectroscopy showed absence of a downfield peak at 185 ppm which would have indicated the presence of a tertiary monocarboxylic acid group and absence of peaks at 177.8 ppm and 178.2 ppm which would have indicated the presence of a tertiary dicarboxylic acid;
4. A comparison of the 220 MHz Nuclear Magnetic Resonance spectrum of the "oxidized product" with that reported for branched nitro-olefins [Bulletin de La Societe Chimique de France 282 (1970)] showed great similarities;
5. Infrared spectrum of a reaction product of polyisobutylene with nitrogen dioxide showed a very strong absorbance band at 1550 $cm^{-1}$ and a weak one at 1710 $cm^{-1}$, as did the infrared spectrum of the oxidized product.

An amount of 200 grams of the "oxidized product", 20 g of tetraethylenepentamine and 200 ml of xylene were placed in a reaction flask equipped with an agitator, a thermometer, a condenser and a Dean-Stark water separator. The reaction mixture was agitated and heated to reflux, 135° to 140° C, and kept at reflux for 20 hours during which time the evolved water was separated and removed in the water-separator. Xylene was then removed by atmospheric distillation. The residue was dissolved in 200 ml of pentane and washed with 250 ml of an isopropanol-water (3:1) mixture. Pentane was then removed by atmospheric distillation leaving the reaction product as a viscous, dark-brown material.

Utility Example A

Hydrolytic and Oxidative Stability

Hydrolytic stability of a composition of this invention was determined by refluxing a solution of the polyisobutylcarboxylic acid amide in chloroform in the presence of sulfuric acid. The test depends upon the fact that as the hydrolysis progresses the amine portion of the amide is liberated and can be extracted away from unhydrolyzed amide with an isopropanol-water mixture. Thus, the degree of nitrogen retention in the amine condensation product can be used as a measure of its hydrolytic stability.

Specifically, the test was carried out by dissolving 10 g of an aminoamide prepared according to the process of Examples 1 and 2 in 100 ml of chloroform in a reaction flask equipped with an agitator, a thermometer, a condenser and an addition funnel. To the stirred solution at room temperature was added a sulfuric acid solution (10 g concentrated sulfuric acid in 40 ml water) over a period of 15 to 20 minutes. The mixture was heated to reflux at 60° C. Samples were withdrawn at the designated times, washed free of acid with a 1:1 isopropanol-water mixture, dried over anhydrous sodium sulfate and the solvent was removed under reduced pressures. The residue was then analyzed for its nitrogen content.

For comparative purposes, a well-known and commercially used lubricant dispersant-detergent additive, Additive A, was subjected to the same hydrolysis conditions. Commercial Additive A is believed to be a polyisobutenylsuccinimide, i.e. a condensation product of tetraethylenepentamine with a polyisobutenylsuccinic acid (or anhydride) where the polyisobutenyl group is of about 1400 molecular weight. The results are summarized below.

| Hydrolytic Stability Test | | | |
|---|---|---|---|
| Compound | Hydrolysis Time Hrs. | Wt. % Nitrogen in Sample | % Nitrogen Retention |
| According to Examples 1 and 2 | 0 | 3.1 | — |
| | 1 | 3.1 | 100 |
| | 3 | 3.1 | 100 |
| | 23 | 2.9 | 93 |
| Commercial Additive A | 0 | 2.0 | — |
| | 1 | 1.9 | 95 |
| | 3 | 1.7 | 85 |
| | 23 | 1.0 | 50 |

The above results show that the aminoamides of the present invention are highly resistant to acid hydrolysis and are considerably superior to the Commercial Additive A in resistance to such hydrolysis.

Utility Example B

Oxidative stability of an aminoamide of the invention was determined by contacting a heated (100° C) sample with air. As in the hydrolytic stability test described above, this test depends upon the observation that, as the oxidative decomposition of the aminoamide proceeds, nitrogen-containing fragments are cleaved from the polyisobutylcarboxylic acid amide and can be extracted away from the unoxidized amide with an isopropanol-water mixture. Nitrogen retention in the sample undergoing this test can thus be used as a measure of its oxidative stability.

The test was carried out by heating 30 g of the aminoamide prepared according to the process of Examples 1 and 2 in a reaction flask equipped with a gas sparger, a thermometer and an agitator. The sample was heated to 100° C under agitation and air was introduced into the sample at a convenient rate. The air sparger was placed so that the air was introduced below the surface of the sample. Heating at 100° C, agitation and air sparging was continued for 23 hours. The sample was cooled, dissolved in 200 ml of hexane, and washed with a 1:1 isopropanol-water mixture. The sample solution was dried over anhydrous sodium sulfate, filtered and the solvent was removed under reduced pressure. The residue was then analyzed for its nitrogen content.

For comparison, Commercial Additive A described in Example A was also subjected to the same oxidation conditions. The results summarized below show that the aminoamide of the present invention is resistant to air oxidation and is superior to the Commercial Additive A in oxidative stability.

| Oxidative Stability Test | | | |
|---|---|---|---|
| Compound | Oxidation Time Hrs. | Wt. % Nitrogen in Sample | % Nitrogen Retention |
| According to Examples 1 and 2 | 0 | 2.9 | — |
| | 23 | 2.6 | 90 |
| Commercial Additive A | 0 | 2.2 | — |
| | 23 | 1.5 | 68 |

Utility Example C

Carburetor Detergency

The usefulness of the invention carboxamides as carburetor detergents in gasoline was demonstrated in a carburetor keep-clean (Onan) test. The test was carried out in a single cylinder engine to which a controlled amount of exhaust gas from another engine was mixed with the air supplied to the test carburetor. The test carburetor throat consisted of a two-piece stainless steel liner fitted around the throttle plate shaft. The liner was easily removed for inspection and rating. The engine is operated under cycling conditions of 1 minute idling and 3 minutes of part throttle for an overall test period of 2 hours. The liner is visually rated on a scale of 0 to 10, a visual rating of 10 being given for a clean carburetor, 0 for a very dirty carburetor. Normally, a rating of at least about 7 is considered satisfactory carburetor detergency. The results are summarized below.

| Carburetor Detergency Keep Clean (Onan) Test | |
|---|---|
| Additive (wt. %) | Onan Rating |
| None (Control Fuel) | 4.5 |
| According to Examples 1 and 2 | 8.4 – 9.0 |

Utility Example D

Piston Skirt Varnish Bench Test

A Piston Skirt Varnish Bench Test was carried out to determine the ability of the dispersant-detergent additive to minimize the formation of a varnish coating on the piston skirts. In the test, a formulated, heated oil (300 ml, 80° C) was pumped at 17 to 18 ml per minute by a bellows pump from a sump through a nozzle onto piston skirt sample coupons ($1\frac{5}{8} \times \frac{7}{8}$ inch cut from Ford aluminum piston). Varnish precursor mixture (16.67% of pyruvic acid, 16.67% of pyruvic aldehyde, 16.67% of 2-nitrobutanol-1, 16.67% of 2-methyl-2-nitropropanol and 33.32% of levulinic acid) was injected (0.01 ml/min) into the oil just ahead of the nozzle. The oil, after contacting the sample coupons, flowed back to the sump to be recirculated.

The piston skirt sample coupons were mounted in a test chamber on stainless steel blocks ($1\frac{3}{8} \times 3 \times \frac{3}{8}$ inch) and were heated to 325° F in an atmosphere rich in NO, HCl and $H_2O$ maintained by feeding NO gas at 20 ml/minute, air at 20 ml/min and nitrogen at 2 cu. ft/hr which had passed through 0.38 N hydrochloric acid solution into the test chamber. To simulate the oil/metal ratio in an engine, 10 g iron filings were placed in the oil sump. The tests were carried out for 8 hours after which time the sample coupons were taken out, rinsed in hexane and rated for varnish formation. The oil used in the test was mineral lubricating oil base stock containing conventionally used oil additives (% by weight): antiwear additive (0.52%); pour point depressant (0.52%); ashless antirust additive (0.52%); ashless antioxidant (1.0%); anticorrosion additive (1.0%); and viscosity index improver (14.8%).

The aminoamide made according to Examples 1 and 2 was evaluated at 2.75 wt. % concentration. The results showed good dispersancy with little or no corrosion of the sample coupons.

For comparison, the condensation product of tetraethylene pentamine with the "oxidized product" from the reaction of polyisobutylene and nitric acid (Comparative Example) was also evaluated in this test at 2.75 wt. % concentration. The results show good dispersancy but extensive corrosion of the sample coupons.

The results of this test show that the aminoamides of the present invention are effective in minimizing the formation of varnish on piston skirts. The different results between the sample of the Comparative Example and that of this invention indicate the magnitude of the difference between the condensation products of tetraethylenepentamine with the "oxidized products" of British patent specification No. 1,027,410, and the aminoamides of the invention.

Utility Example E

Lubricant Detergency Test

CLR-LTD tests were carried out with the aminoamides of the invention in a lubricating oil to demonstrate the low temperature dispersancy characteristics in an engine. The tests were carried out essentially as prescribed in Federal Test Method Standard, Method 348 except for the following modifications:

Test Duration 96 hours (vs. 180 hrs).

Air Fuel Ratio 15.25 ± 0.25 (vs. 14.5 ± 0.5).

Jacket Coolant Temperature Phase 1, 150° F (vs. 120° F); Phase 2, 180° F (vs. 200° F).

At the completion of the test, the engine was disassembled and rated for sludge and varnish depositions according to the standard CRC Deposit Rating Scales. The results summarized below show that the aminoamides of the present invention are effective dispersant-detergents in lubricating oils.

Lubricating Oil Detergency CLR-LTD Tests

| Additive | Wt. % | Deposit Ratings: Sludge (50=clean) | Piston Skirt Varnish (10=clean) | Overall Varnish (50=clean) |
|---|---|---|---|---|
| None | — | 32.1 | 5.9 | 27.8 |
| Prepared According to Examples 1 and 2 | 0.5 | 48.1 | 6.6 | 38.6 |
| | 0.3 | 40.4 | 6.4 | 36.0 |
| Prepared According to Example 3 | 0.3 | 37.1 | 6.1 | 35.9 |

Utility Example F

The effectiveness of aminoamide of Example 1 as a gasoline detergent to control deposit formation in a quick-heat intake manifold was determined on an engine (Pontiac engine) stand. Such quick-heat intake manifold has been proposed to minimize carbon monoxide emissions without engine stalling during the engine warm-up period by effecting better fuel evaporation by the time the choke is off. This is accomplished by having the fuel droplets from the carburetor impinge upon a heated plate. The plate is designed to hold the droplets until evaporation takes place. One difficulty with such a system, also called Early Fuel Evaporation (EFE) system, is that the high boiling ends of the fuel remaining in contact with the heated surface tend to decompose and form deposits. As the deposit accumulation increases, the plate becomes ineffective in vaporizing fuel and thus engine stalling can occur when the choke is off during the engine warm-up period. An effective gasoline detergent additive will minimize the deposit formation.

In this test the EFE plate was positioned directly below the carburetor equipped with a riser, the end of the riser being about 1 inch from the surface of the plate. The plate was electrically heated. The central portion of the plate was kept at about 149° C, the outer edge at about 205° C giving an average plate temperature of about 177° C. The deposit forming tendency of a fuel is determined by measuring the rate of temperature rise of the EFE plate surface by means of a thermocouple lead placed thereon. As deposits accumulate, the efficiency of the plate to vaporize fuel decreases and is accompanied by a rise in the plate surface temperature. Thus, in the absence of any deposit formation, the rate of temperature rise is zero.

In the present tests the engine was operated for 46 hours. The base fuel used was unleaded industry-known "Indolene". The average rate of temperature rise of the EFE plate surface was measured. Additionally, at the end of the test period, the EFE plate was visually rated for the degree of cleanliness (10 = clean).

The aminoamide of Example 1 was added to unleaded "Indolene" at a level of 50 pounds per thousand barrels (ptb). For comparison purposes, polyisobutylcarboxylic acid aminoamide prepared from ethylenediamine according to the procedure of Example 1 and from the same polyisobutylcarboxylic acid used in Example 1 was also tested at 50 ptb. This Example demonstrates that the invention aminoamide (made from tetraethylenepentamine) is superior to the aminoamide prepared from ethylenediamine in the control of quick-heat intake manifold deposits. The results are summarized below.

Early Fuel Evaporation Deposit Tests

| Additive | ptb | Rate of Temperature Rise ° F | Deposit Rating (10 = clean) |
|---|---|---|---|
| None | — | 3.5 | 2.6 |
| Amide of Example 1 | 50 | 0.2 | 8.0 |
| Amide Prepared From The Acid of Example 1 and ethylenediamine | 50 | 1.6 | 4.4 |

The embodiments of the invention in which an exclusive property or privilege is claimed are defined as follows:

1. A carboxamide composition comprising N-substituted amides of polyisobutylcarboxylic acids, the polyisobutylcarboxylic acid component of the carboxamide consisting essentially of a mixture of (i) at least about 80%, by weight, of a polyisobutylcarboxylic acid component characterized by substantially all carboxyl groups being attached to tertiary carbon atoms, and by less than about 20% of said acid component being extractable by successive treatments at 25° C with aqueous alkali and with water, and (ii) up to about 20%, by weight, of a neutral polyisobutyl component, the polyisobutyl groups of components (i) and (ii) having an average molecular weight of about 750 to 3000;

the N-substituted component of the carboxamide having the formula, —N(R)Z, where R is hydrogen or lower alkyl, and Z is

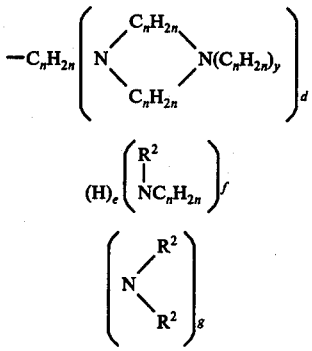

where $n$ is 2 or 3, $R^2$ is independently hydrogen or lower alkyl, $d$, $e$, $g$, and $y$ are 0 or 1, and $f$ is 0 to 5, with the provisos that:

a. when $d = 0$, then $e = 0$, $f = 1$ to 5 and $g = 1$, b. when $d = 1$ and $y = 0$, then $e = 1$ and $f$ and $g$ are 0, and c. when $d = 1$ and $y = 1$, then $e = 0$, $f = 1$ to 5 and $g = 1$.

2. A composition according to claim 1 wherein the polyisobutyl group has an average molecular weight of about 1200 to 2000.

3. A composition according to claim 2 wherein $n = 2$, and $R = R^2 =$ hydrogen.

4. A composition according to claim 3 wherein —N(R)Z is $—NHC_2H_4(NHC_2H_4)_3NH_2$.

5. A composition according to claim 2 wherein —N(R)Z is $—NHC_3H_6N(CH_3)C_3H_6NH_2$.

6. A composition according to claim 2 wherein —N(R)Z is $—NHC_3H_6(NHC_2H_4)_4NHC_3H_6NH_2$.

7. A composition according to claim 2 wherein —N(R)Z is $—NHC_3H_6NHC_2H_4NHC_4H_6NH_2$.

8. A composition according to claim 2 wherein —N(R)Z is $—NHC_3H_6NHC_3H_6N(CH_3)C_3H_6NHC_3H_6NH_2$.

9. A solution containing from 10% to 95% by weight of the composition according to claim 1.

* * * * *